US010690391B2

(12) United States Patent
Millett

(10) Patent No.: US 10,690,391 B2
(45) Date of Patent: Jun. 23, 2020

(54) APPLIANCE USING HEATED GLASS PANELS

(71) Applicant: Whirlpool Corporation, Benton Harbor, MI (US)

(72) Inventor: Fred A. Millett, Turtletown, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 1359 days.

(21) Appl. No.: 13/835,752

(22) Filed: Mar. 15, 2013

(65) Prior Publication Data

US 2014/0260384 A1 Sep. 18, 2014

(51) Int. Cl.

| | |
|---|---|
| ***F25D 21/00*** | (2006.01) |
| ***H05B 3/84*** | (2006.01) |
| ***F25D 21/08*** | (2006.01) |
| ***F25D 23/02*** | (2006.01) |

(52) U.S. Cl.

CPC ..... *F25D 21/002* (2013.01); *F25D 21/08* (2013.01); *H05B 3/84* (2013.01); *F25D 23/02* (2013.01); *H05B 2203/013* (2013.01); *H05B 2203/032* (2013.01)

(58) Field of Classification Search

CPC ..... F25D 23/02; F25D 23/063; F25D 21/08; F25D 2321/14; H05B 3/84; H05B 2203/013; H05B 2203/032

See application file for complete search history.

(56) References Cited

U.S. PATENT DOCUMENTS

| | | | | | |
|---|---|---|---|---|---|
| 1,588,707 | A * | 6/1926 | Csiga | F25D 23/06 | 217/131 |
| 2,623,971 | A * | 12/1952 | Glynn | F24C 7/043 | 219/203 |
| 2,709,211 | A * | 5/1955 | Glynn | H01C 1/14 | 338/292 |
| 2,749,717 | A * | 6/1956 | Duncan | F25D 21/08 | 219/218 |
| 2,900,806 | A * | 8/1959 | Wurtz | F25B 47/022 | 62/155 |
| 3,099,914 | A * | 8/1963 | De Witt | F25D 21/008 | 219/200 |
| 3,195,320 | A * | 7/1965 | Kita | F25D 21/008 | 174/152 R |
| 3,393,530 | A * | 7/1968 | Koch | F25D 17/065 | 62/275 |
| 3,590,596 | A * | 7/1971 | Johnson | F25D 17/065 | 62/275 |
| 3,638,449 | A * | 2/1972 | Lichtenberger | F25D 17/062 | 62/272 |
| 3,904,721 | A * | 9/1975 | Puterbaugh | F25D 23/061 | 264/275 |

(Continued)

FOREIGN PATENT DOCUMENTS

| | | |
|---|---|---|
| CA | 1130847 A | 8/1982 |
| EP | 0352499 A2 | 1/1990 |

(Continued)

*Primary Examiner* — Nelson J Nieves

(74) *Attorney, Agent, or Firm* — Nyemaster Goode, P.C.

(57) ABSTRACT

Appliances are provided with one or more heated glass panels that provide a uniform and controllable source of heat. The heated glass panels can generate heat for any desired purpose, such as drying articles and removing frost buildup in a freezer.

18 Claims, 10 Drawing Sheets

(56) References Cited

U.S. PATENT DOCUMENTS 3,905,203 A * 9/1975 Jacob ..... F24F 3/1405 165/110
3,911,245 A 10/1975 O'Shaughnessy
3,940,195 A * 2/1976 Tillman ..... F25D 23/064 220/592.1
4,032,751 A 6/1977 Youtsey et al.
4,453,669 A 6/1984 Karla et al.
4,920,254 A * 4/1990 DeCamp ..... H05B 3/86 219/203
5,005,020 A * 4/1991 Ogawa ..... B32B 17/10 343/713
5,058,392 A * 10/1991 Jouan ..... E04H 4/129 62/238.6
5,545,878 A * 8/1996 Jasper, II ..... F25D 21/08 219/541
5,552,581 A * 9/1996 Jasper, II ..... H05B 3/44 219/523
5,632,543 A * 5/1997 McGrath ..... F25D 23/063 220/592.09
5,709,096 A * 1/1998 Tamai ..... A47F 3/0447 62/155
5,766,739 A * 6/1998 Funaki ..... H05B 3/84 219/203
5,826,442 A * 10/1998 Lee ..... F25D 17/065 62/275
5,852,284 A 12/1998 Teder et al.
6,144,017 A 11/2000 Millett et al.
6,268,594 B1 7/2001 Leutner et al.
6,324,853 B1 * 12/2001 Kelly ..... F25D 21/008 62/151
6,536,227 B1 * 3/2003 Lee ..... F25B 39/02 165/171
7,002,115 B2 2/2006 Gerhardinger et al.
7,241,964 B2 7/2007 Gerhardinger et al.
7,246,470 B2 7/2007 Beyrle
7,265,323 B2 9/2007 Gerhardinger et al.
7,301,126 B2 11/2007 Mann
7,968,823 B2 6/2011 Gerhardinger
8,653,419 B2 * 2/2014 Weiss ..... H05B 3/84 219/202
9,651,292 B2 * 5/2017 Jung ..... F25D 11/00
2001/0003336 A1 * 6/2001 Abbott ..... F27D 11/02 219/543
2003/0102465 A1 * 6/2003 Nagai ..... C03C 8/18 252/500
2005/0193760 A1 * 9/2005 Moran ..... F25D 11/003 62/371
2006/0032266 A1 * 2/2006 Gagnon ..... B65D 81/3818 62/457.2
2007/0235441 A1 10/2007 Winsler
2008/0104973 A1 * 5/2008 Hall ..... F25D 21/08 62/80
2008/0209954 A1 9/2008 Nakiri
2010/0287974 A1 * 11/2010 Cur ..... F25D 23/063 62/449
2011/0073586 A1 * 3/2011 Lim ..... F25D 21/08 219/546
2011/0283724 A1 * 11/2011 Bai ..... F25D 21/04 62/150
2012/0198863 A1 * 8/2012 Hall ..... F25D 21/08 62/80

FOREIGN PATENT DOCUMENTS

EP 1295169 A1 3/2003
GB 2456392 A 7/2009
NL 1016261 C1 3/2002
WO 2007074115 A1 7/2007

* cited by examiner

APPLIANCE USING HEATED GLASS PANELS

FIELD

This disclosure relates to appliances. In particular, this disclosure is drawn to appliances that use heated glass panels as heat sources.

BACKGROUND

Household appliances use heat sources to generate heat for various purposes. For example, dishwashers, laundry washers, and laundry dryers use heat sources to dry articles such as dishes and clothing. In another example, some refrigerators and freezers use heat sources during defrost cycles to remove frost buildup in the freezer. Typical appliances use concentrated high wattage heaters and use fans or blowers to distribute the heat to desired locations. This results in uneven heat distribution in the appliance.

SUMMARY

An appliance is provided including a cabinet, an outer shell defining the cabinet exterior, an inner liner defining the cabinet interior, insulation disposed between the outer shell and the inner liner, and one or more heated glass panels disposed between the inner liner and the insulation.

Another embodiment provides a refrigeration appliance having an automatic defrost cycle including a cabinet defining a freezer compartment, a defrost cycle heater for providing a heat source during an automatic defrost cycle, wherein the defrost cycle heater includes one or more heated glass panels, and a controller configured to control the defrost cycle heater during a defrost cycle.

Another embodiment provides an appliance having an automatic washing and drying cycles for washing and drying articles, the appliance including a cabinet, an outer wall defining the cabinet exterior, an inner wall defining the cabinet interior, and one or more heated glass panels disposed between the outer wall and the inner wall of the cabinet for providing a heat source for drying washed articles.

Other features and advantages of the present disclosure will be apparent from the accompanying drawings and from the detailed description that follows below.

BRIEF DESCRIPTION OF THE DRAWINGS

The present disclosure is illustrated by way of example and not limitation in the figures of the accompanying drawings, in which like references indicate similar elements and in which.

DETAILED DESCRIPTION

Generally, the present disclosure relates to using heated glass panels as a source of heat in appliances. Heated glass panels are sheets of glass that include transparent, electrically conductive coatings (e.g., Tin(II) oxide) applied to the surface of the glass. The conductive coating has a resistance, and generates heat when current flows through the coating. At opposite edges of the glass, busbars are formed to function as electrodes, so a voltage differential can be applied to the busbars, causing current to flow through the coating, warming the glass, which radiates heat. In an appliance, one or more heated glass panels can be used to generate the desired amount of uniform heat. With a uniform source of heat, the need for a circulation fan may be eliminated, although the combination of heated glass panel (s) and a circulation fan may also provide advantages in some applications.

The following description will be described in the context of providing heat sources in appliances such as refrigerators, dishwashers, laundry washers, and laundry dryers. It shall be understood that the concepts described also apply to other appliances and other applications.

Figure 1:
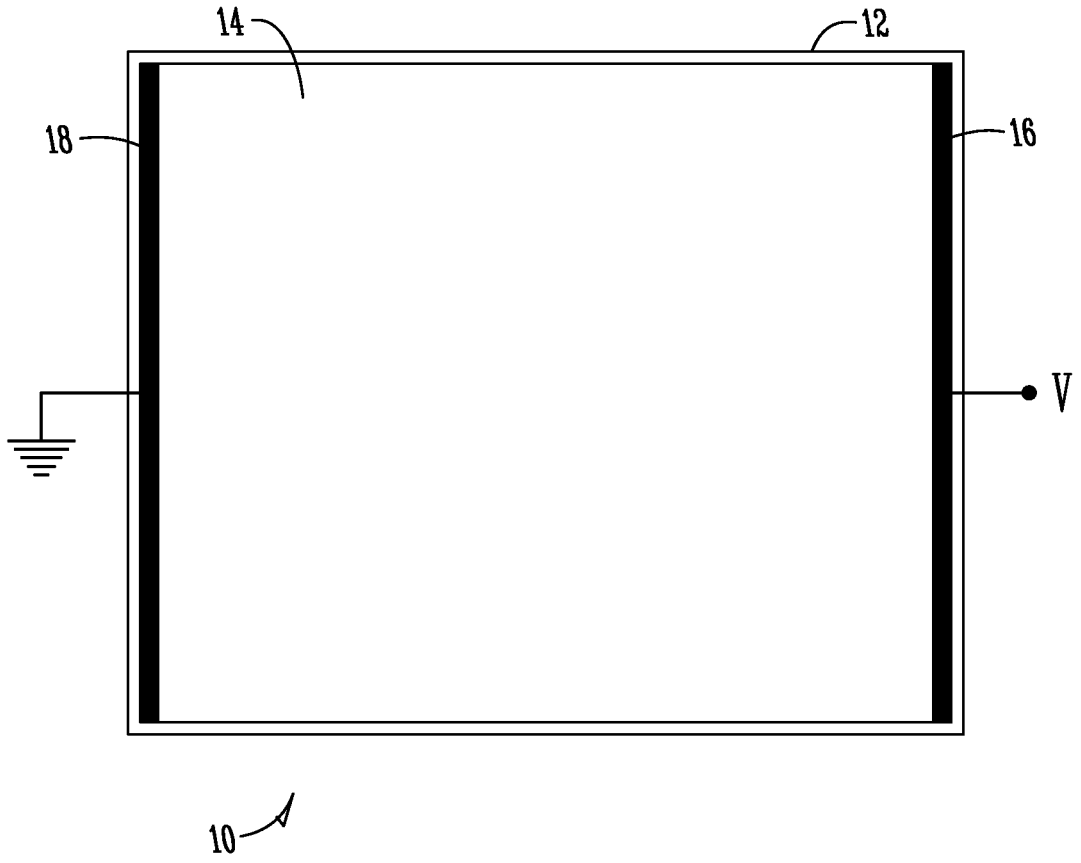
FIG. 1 shows one example of a heated glass panel.

FIG. 1 shows one example of a heated glass panel that may be used in the exemplary embodiments. Other configurations of heated glass panels may also be used. FIG. 1 shows a heated glass panel 10, including a glass pane 12 and an electrically conductive coating 14 on the surface of one side of the glass pane 12. Two busbars 16 and 18 are formed on the glass pane and are electrically connected to the conductive coating 14 to form two terminals. In one example, the busbar material is silver paste or copper applied directly to the glass surface. When a voltage differential is applied to the busbars 16 and 18, current flows through the coating 14, generating heat and warming the glass pane 12. Various factors determine how much heat is produced, including the applied voltage, the resistance of the coating, etc.

The use of heated glass panels in appliances will be described in the context to two construction styles, although other configurations may also be used. A first type of construction relates to appliances that use insulated cabinet walls having outer shells and inner liners. Examples of appliances that use this type of construction include refrigerators, freezers, and dish washers. A second type of construction relates to appliances that use a rotating drum within an outer shell. Examples of appliances that use this type of construction include laundry washers and dryers.

Figure 2:
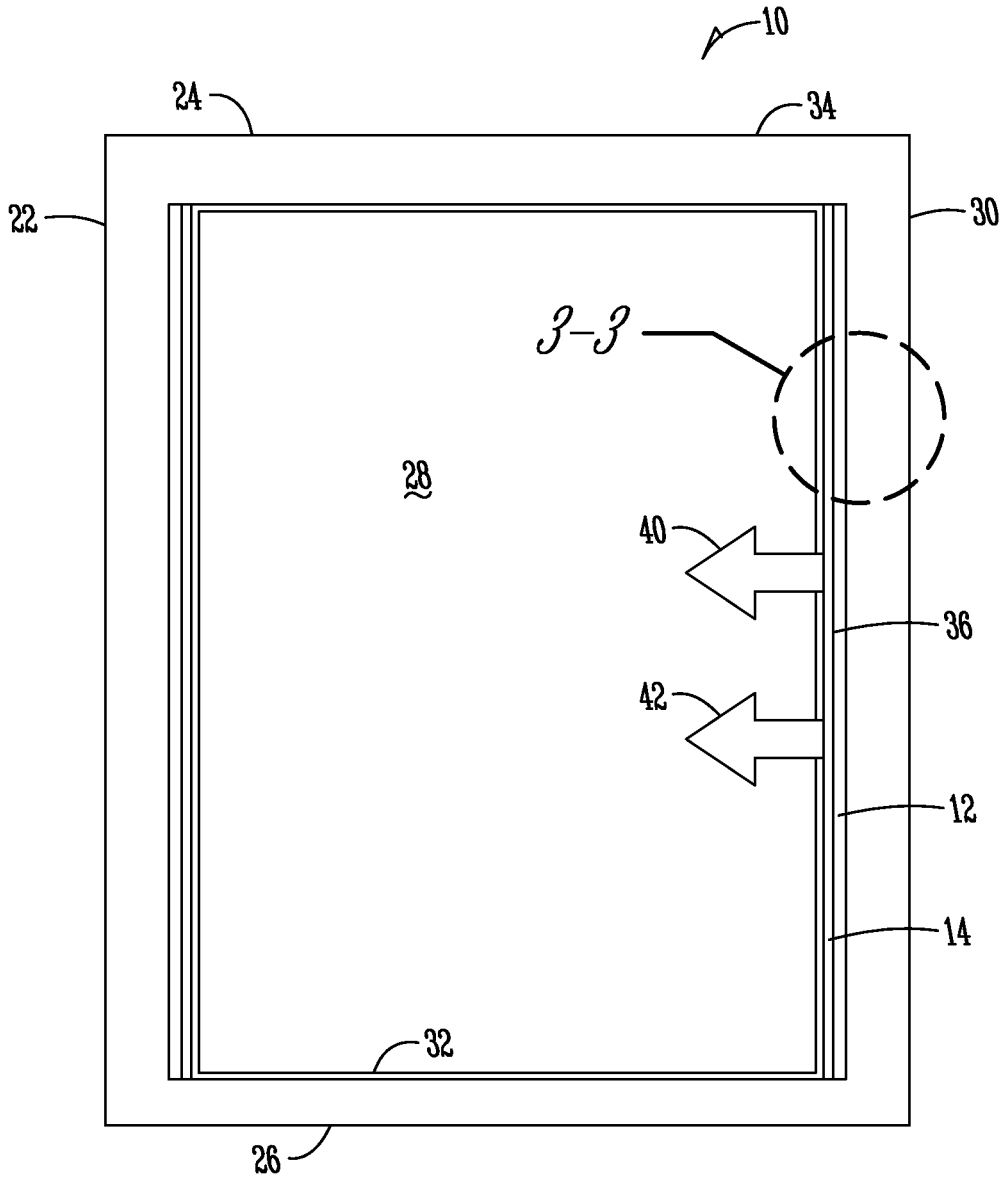
FIG. 2 is a top sectional view of an appliance cabinet having heating elements formed within the walls of the cabinet.

FIG. 2 is a top sectional view of an appliance cabinet having heating elements formed within the walls of the cabinet. FIG. 2 is not drawn to scale. An appliance cabinet 20 has side walls 22, a rear wall 24, a front wall 26, a bottom wall 28, and a top (not shown). In the example of a cabinet for a refrigerator or dishwasher, a door would be formed in the front wall 26. In this example, heated glass panels are disposed in the side walls 22. In other examples, heated glass panels can be formed in any of the six walls. In addition, a heated glass panel can be used in the appliance door to form a viewing window.

Figure 3:
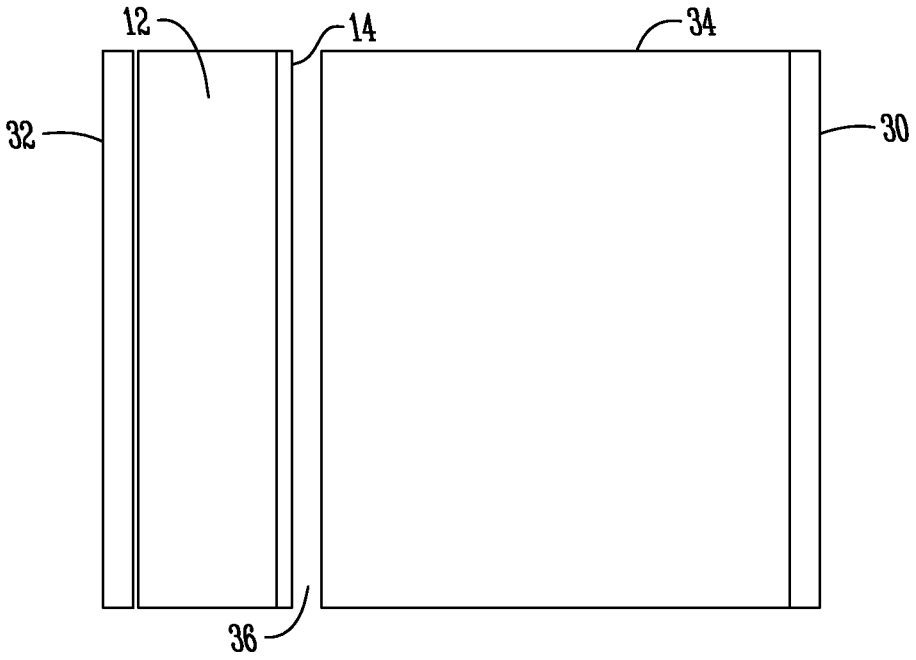
FIG. 3 is an enlarged partial view taken along lines 3-3 of FIG. 2.

FIG. 3 is an enlarged partial view taken along lines 3-3 of FIG. 2. The walls of the cabinet include an outer shell 30 and an inner liner 32. The outer shell 30 can be made from any desired material, including stainless steel, other metals, plastic, fiber glass, etc. The inner liner 32 can also be made from any desired material, including stainless steel, other metals, plastic, fiber glass, etc. A body of insulation 34 is disposed between the outer shell 30 and inner liner 32. In the example shown in FIG. 2, a heated glass panel is used as a heat source in both side walls 22. The heated glass panels 10 are disposed between the insulation 34 and the inner liner 32. As shown best in FIG. 3, the heated glass panel 10 includes a glass pane 12 and an electrically conductive coating 14. In the example shown in FIGS. 2 and 3, an optional air space 36 is formed between the coating 14 of the glass 12 and the insulation 34. While FIGS. 2 and 3 show the heated glass panels 10 with the coating side facing out, the panels 10 could also be oriented with the coating side facing inward.

When a voltage is applied to the busbars 16 and 18 of the heated glass panel 12, the glass panel 12 will heat the glass pane 12 and transfer heat to the liner 32 and the interior of the cabinet by thermal conduction, as illustrated by arrow 40. With the air gap 36, the conductive coating 14 of the glass panel 10 acts as a low-emittance (low-E) surface, which will direct heat back into the interior of the cabinet, as illustrated by arrow 42. The heat generated by the glass panel 12 will be relatively uniform, resulting in a more uniform heat distribution inside the cabinet 20 than with conventional concentrated heat sources. If desired, heated glass panels could also be formed in the front, rear, bottom, and top walls. In addition, a heated glass panel could form a viewing window in the appliance door. Following are two examples of appliances using the construction style illustrated in FIGS. 2 and 3.

Figure 4:
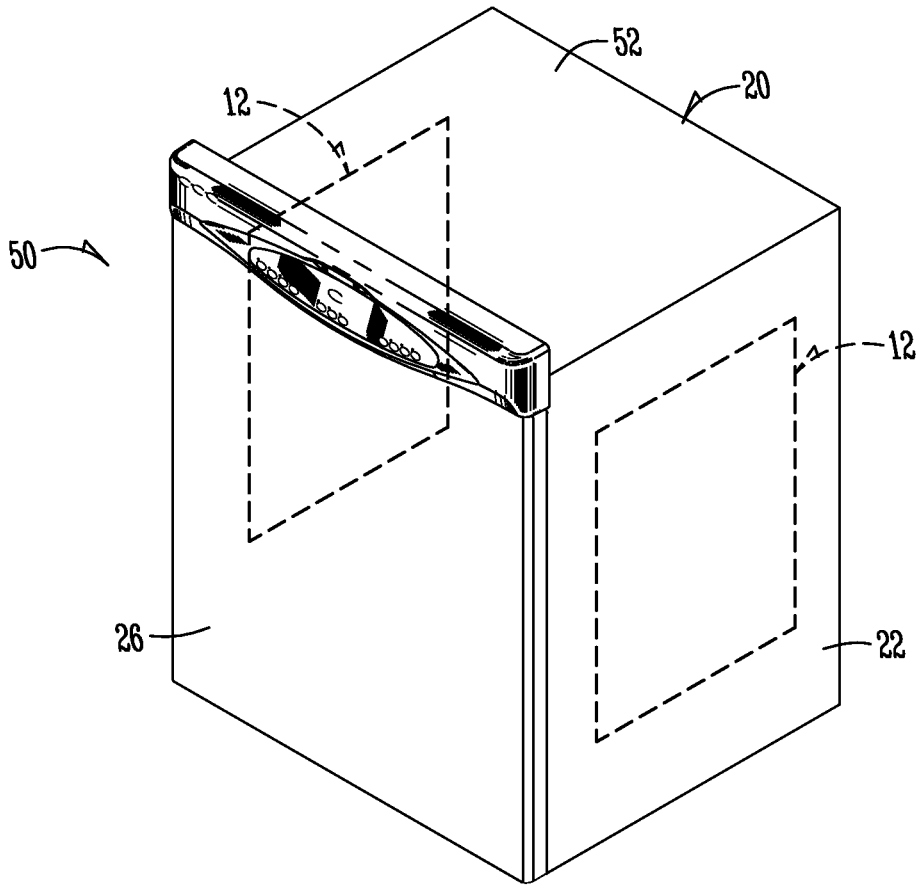
FIG. 4 is an isometric view of a dishwasher using heated glass panels.

FIG. 4 is an isometric view of a dishwasher 50. The dishwasher 50 includes a cabinet 20 having side walls 22, a top wall 52, a rear wall (not shown), a front wall 26 (in this example, including a door), and a bottom wall (not shown). The walls of the cabinet 20 are constructed as illustrated in FIGS. 2 and 3. In this example, a heated glass panel 12 (shown with dashed lines) is formed in each of the side walls 22. In other examples, heated glass panels could also be formed in any of the other cabinet walls.

The operation of the dishwasher 50 includes a drying cycle used to remove water from dishes after they go through a cleaning cycle. When the dishwasher 50 goes through a drying cycle, the heated glass panels 12 are energized, generating heat in the interior of the cabinet 20. As mentioned above, the heated glass panels will generate uniform heat over a relatively large area, improving the performance over typical dishwashers, while also eliminating the need for circulation fans, which might be used with conventional concentrated heat sources.

Figure 5:
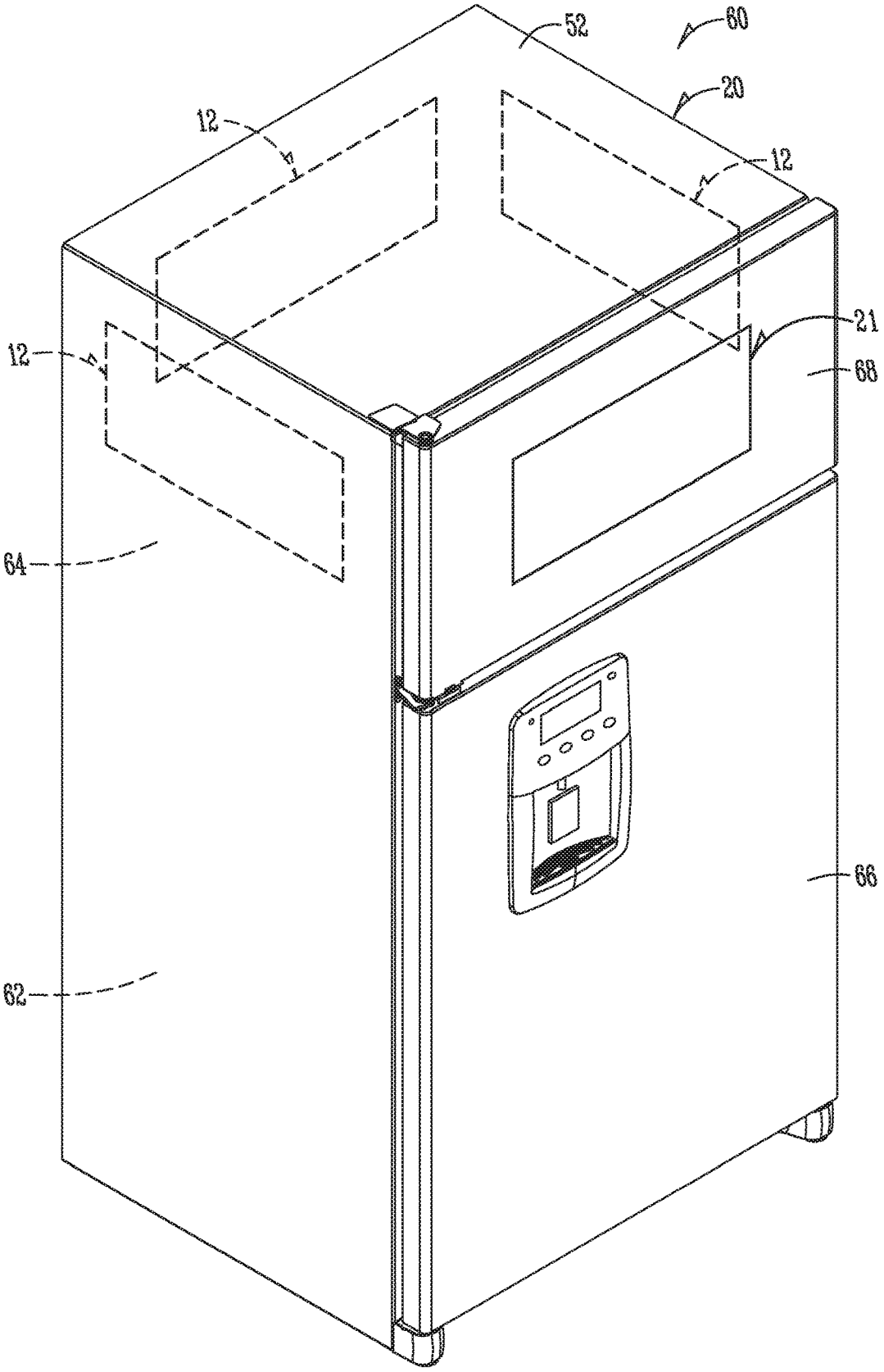
FIG. 5 is an isometric view of a refrigerator using heated glass panels.

FIG. 5 is an isometric view of a refrigerator 60. The refrigerator 60 includes a cabinet 20 having glass panel/viewing window 21, side walls 22, a top wall 52, a rear wall (not shown), and a bottom wall (not shown). The refrigerator 60 has a lower fresh food compartment 62 and an upper freezer compartment 64. A door 66 provides access to the fresh food compartment 62. A door 68 provides access to the freezer compartment 64. Other refrigeration configurations are side by side and French door bottom freezer are others. The walls and doors of the cabinet 20 are constructed as illustrated in FIGS. 2 and 3. In this example, three heated glass panels 12 (shown with dashed lines) are formed in the side and rear walls of the freezer compartment 64. In other examples, heated glass panels could also be formed in any of the other freezer compartment walls.

The operation of the refrigerator 60 includes a defrost cycle used to remove frost buildup in the freezer compartment 64. During a defrost cycle, the heated glass panels 12 are energized, melting frost buildup on the inner liner of the freezer compartment walls. As mentioned above, the heated glass panels will generate uniform heat over a relatively large area, improving the performance over typical refrigerators, while also eliminating the need for circulation fans, which might be used with conventional concentrated heat sources.

Figure 7:
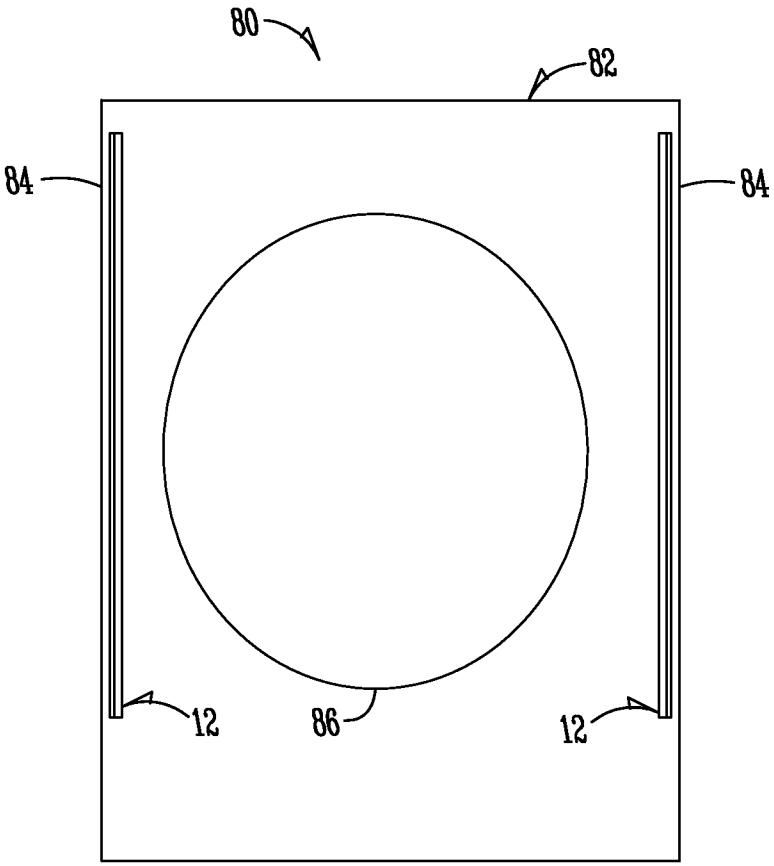
FIGS. 6 and 7 are front sectional diagrams representing appliances having vertically and horizontally oriented rotating drums.
Figure 6:
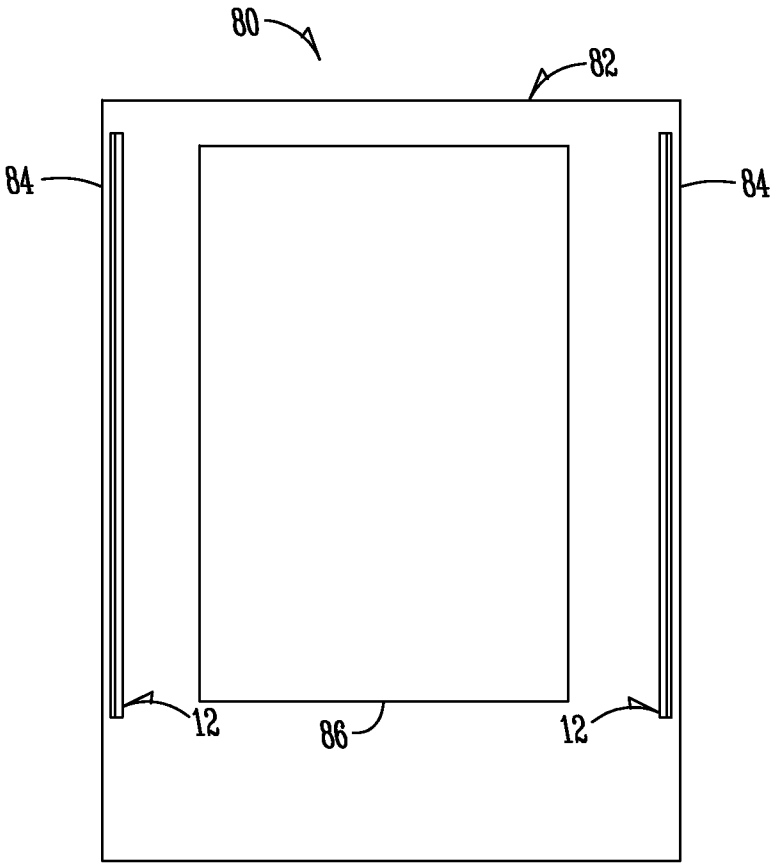

The second type of construction mentioned above relates to appliances that use a rotating drum within an outer shell. FIGS. 6 and 7 are front sectional diagrams representing appliances 80 having a vertically (FIG. 6) or horizontally (FIG. 7) oriented rotating drums. For clarity, only the walls, drums, and heat sources are shown. The appliance 80 has a cabinet 82, including side walls 84. A heated glass panel 12 is coupled to each side wall 84 between the respective side wall 84 and a rotating drum 86. Similar to the example illustrated in FIGS. 2 and 3, an air space 36 is formed between the coating of the glass and the side wall 84.

When a voltage is applied to the busbars 16, 18 of the heated glass panel 12, the glass panel 12 will heat the glass pane 12, which will transfer to the interior of the cabinet and to the drum 86. The glass coating and air gap combine to also reflect heat toward the drum 86 and to insulate the heat from the outer shell of the appliance. The heat generated by the glass panel 12 will be relatively uniform, resulting in a more uniform heat distribution inside the cabinet 82 than with conventional heat sources. If desired, heated glass panels could also be formed in the front, rear, bottom, and top walls. In addition, a heated glass panel could form a viewing window in the appliance door. Following are two examples of appliances using the construction style illustrated in FIGS. 6 and 7.

Figure 8:
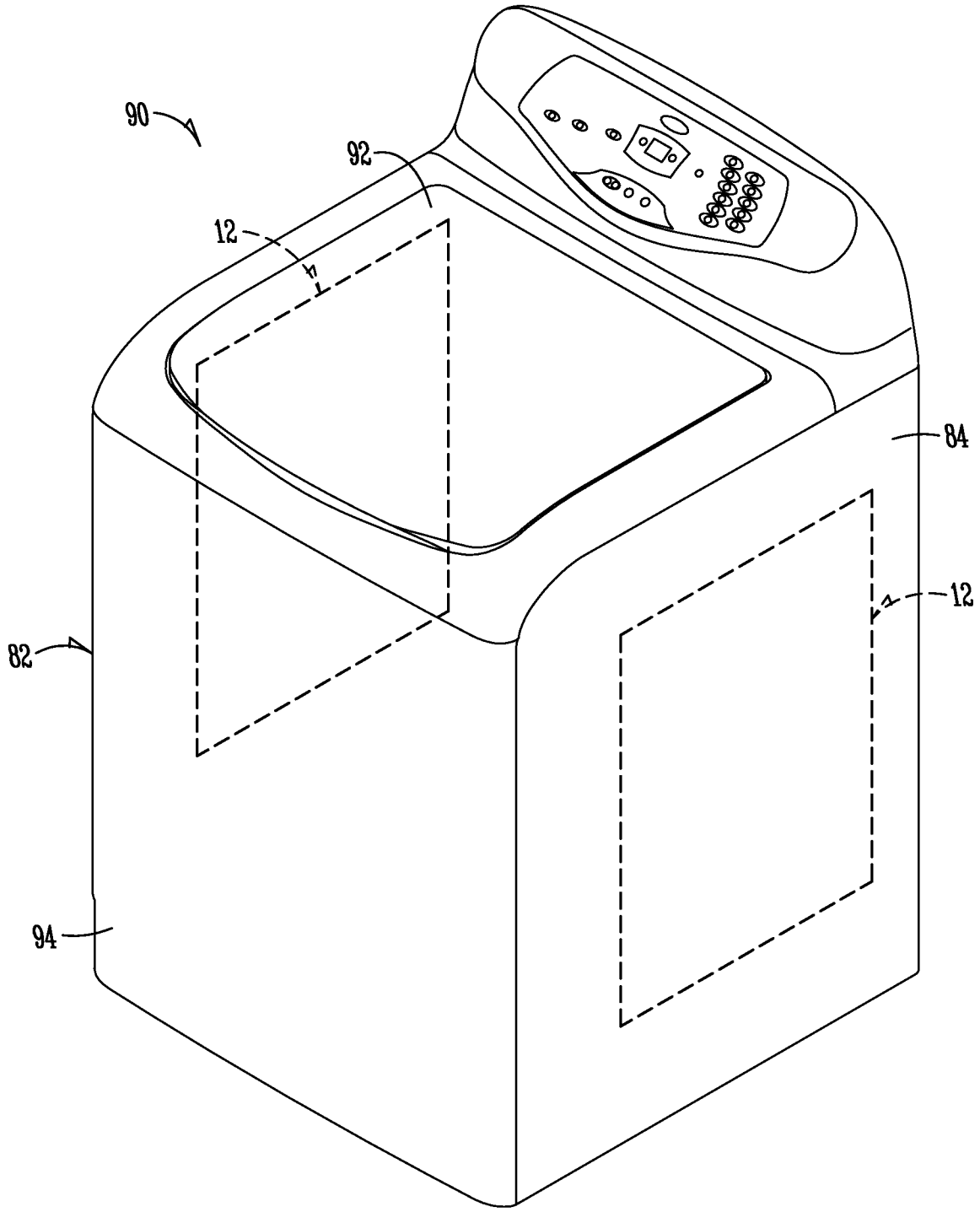
FIG. 8 is an isometric view of a top-loading appliance using heated glass panels.

FIG. 8 is an isometric view of a top-loading laundry washing machine 90 having a vertically oriented rotating drum (not shown), as illustrated in FIG. 6. The washing machine 90 includes a cabinet 82 having side walls 84, a top wall 92 (in this example, including a door), a rear wall (not shown), a front wall 94, and a bottom wall (not shown). In this example, a heated glass panel 12 (shown with dashed lines) is coupled to each of the side walls 84, between the side walls 84 and the rotating drum. In other examples, heated glass panels could also be formed in any of the other cabinet walls. In addition, a heated glass panel can be used in the door to form a viewing window.

In addition to washing cycles, the operation of the washing machine 90 includes drying cycles. During a drying cycle (after wash water has drained and after a spin cycle), the laundry in the drum is tumbled and the heated glass panels 12 are energized, generating heat in the interior of the cabinet 82. As mentioned above, the heated glass panels will generate uniform heat over a relatively large area, improving the performance over typical drying cycle of a washing machine.

Figure 9:
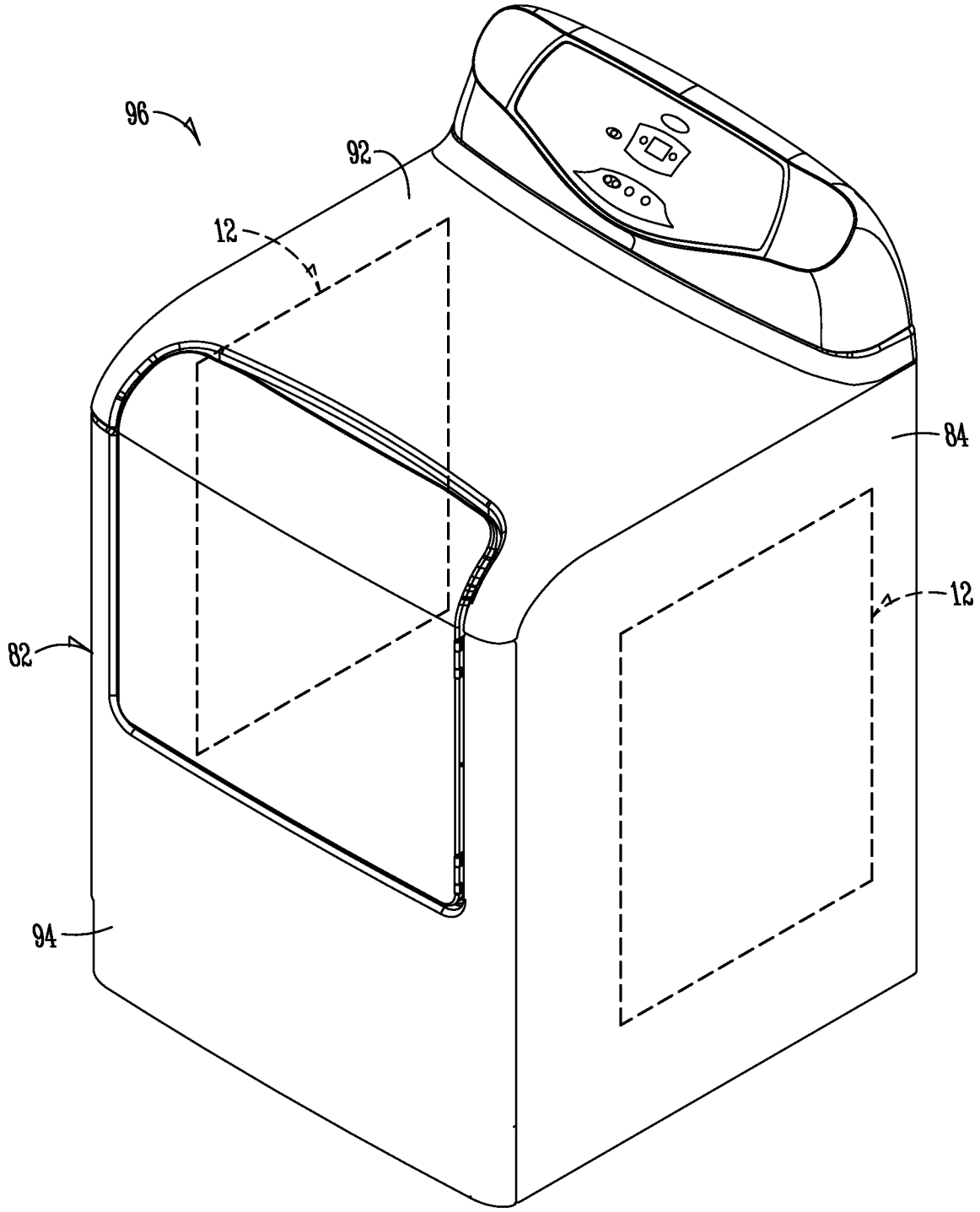
FIG. 9 is an isometric view of a front-loading appliance using heated glass panels.

FIG. 9 is an isometric view of a front-loading appliance 96, which could be a laundry dryer, or a combination washing machine and dryer. The appliance 96 has a generally horizontally oriented rotating drum (not shown), as illustrated in FIG. 7. The appliance 96 includes a cabinet 82 having side walls 84, a top wall 92, a rear wall (not shown), a front wall 94 (in this example, including a door), and a bottom wall (not shown). In this example, a heated glass panel 12 (shown with dashed lines) is coupled to each of the side walls 84, between the side walls 84 and the rotating drum. In other examples, heated glass panels could also be used with any of the other cabinet walls. In addition, a heated glass panel can be used in the door to form a viewing window.

Whether the appliance 96 is dryer, or a combination washing machine and dryer, the operation of the appliance 96 includes drying cycles. During a drying cycle, the laundry in the drum is tumbled and the heated glass panels 12 are energized, generating heat in the interior of the cabinet 82. As mentioned above, the heated glass panels will generate uniform heat over a relatively large area, improving the performance over typical appliance.

Figure 10:
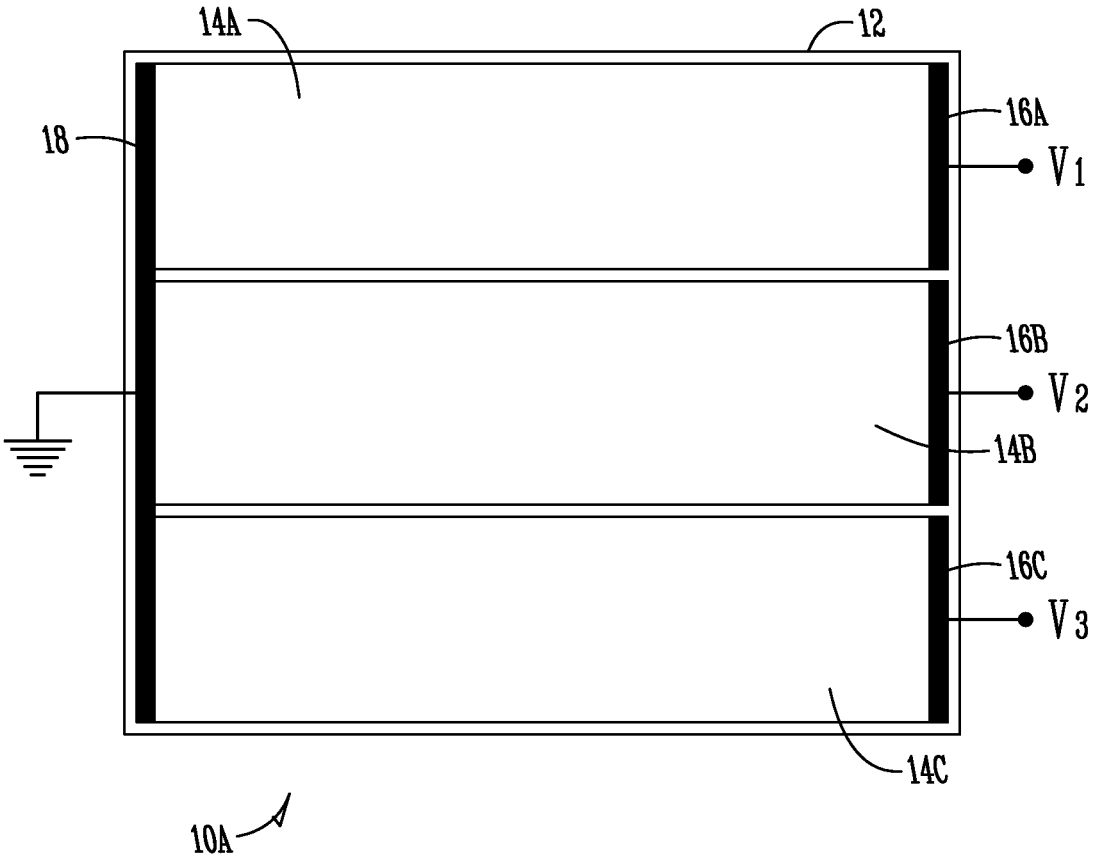
FIG. 10 shows a multi-zone a heated glass panel.

FIG. 1 (described above) illustrated one example of a heated glass panel for use as a heat source. While the heated glass panels described above provide a uniform heat source, in some applications, it may be desirable to have a more precise and controllable heat source. For example, in a dishwasher, it may be desirable to create air flow in the dishwasher cabinet by generating more heat from a lower position, causing heated air to flow upward and using convection to help dry dishes. FIG. 10 is a diagram of one example of a heated glass panel that enables more flexible and precise heating functions.

FIG. 10 shows a heated glass panel 10A, including a glass pane 12 and a plurality of independent electrically conductive coatings 14A, 14B, and 14C, forming independently controllable zones on the glass pane 12. A busbar 18 is formed on the glass pane and is electrically connected to each of the conductive coatings 14A, 14B, and 14C. On the opposite end of the panel 10A, each conductive coating 14A, 14B, and 14C is electrically connected to a separate busbar 16A, 16B and 16C, respectively, to form three terminals, labeled V1, V2 and V3. Each of the conductive coatings of the heated glass panel 10A can be controlled independently by selectively applying a voltage to the terminals V1, V2 and V3. A controller can precisely control the heated glass panel 10A by selectively energizing the separate coatings and/or independently controlling the intensity of each coating by varying the applied voltage, switching in or out capacitors, etc. Other control schemes are also possible, such as pulsing power (e.g., using pulse width modulation) through the coatings, etc. If desired, the heated glass panel 10A can be controlled with the use of temperature sensors to provide feedback to more precisely control the temperature, and also to compensate the change in resistance in the coatings as the temperature increases. A multi-zone heated glass panel can be designed in any desired manner to create a panel with as many zones as desired, or with any coating layout desired.

Figure 11:
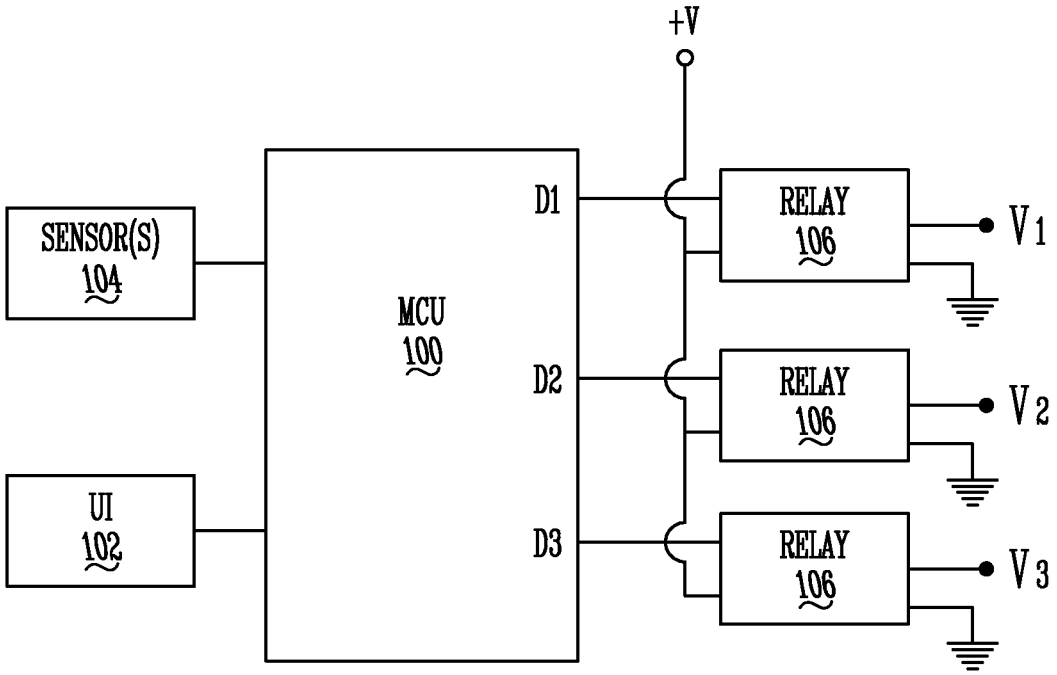
FIG. 11 is a circuit diagram of a control circuit for controlling heated glass panels.

FIG. 11 is an example of a control circuit for controlling the multi-zone heated glass panel 10A shown in FIG. 10. The same control techniques can also control a single zone panel (e.g., FIG. 1), multiple single zone panels, a plurality of multiple zone panels, or any combination thereof. Note that FIG. 11 is merely one example of a control circuit for controlling one or more heated glass panels, as one skilled in the art would understand.

FIG. 11 shows a microcontroller 100 coupled to a user interface 102 and one or more optional sensors 104. The user interface may include an appliance control panel, a remote device (e.g., via an IR, Bluetooth, Wifi, connection, etc.), or any other desired user interface. The sensors may include any desired sensors, such as temperature sensors, hygrometers, air flow sensors, door open sensors, resistance sensors (to sense the resistance of the coatings), moisture sensing electrodes, etc. The microcontroller 100 can be programmed to control the heated glass panels in any desired manner. For example, the interior of an appliance cabinet can include temperature sensors in desired locations, providing feedback to the microcontroller, so the microcontroller can selectively energize and/or regulate specific zones on specific glass panels, to create ideal drying conditions. The microcontroller 100 has digital outputs D1, D2, and D3, which are each associated with a zone of the heated glass panel 10A. Alternatively, the microcontroller 100 could combine a serial output with one or more shift registers to control any number of zones. In this example, each digital output is electrically connected to a relay 106, which acts as a switch to apply voltage V+ to the heated panel terminals V1, V2 and V3. V+ can be any desired operating voltage, such as 120VAC, 240VAC, etc.

The embodiments described above provide just a few examples of possible implementations and applications of the disclosed concepts. The concepts described can be applied to other applications. For example, the heated glass panels described above, can be used as a heat source for other appliances and uses, such as food warmers, frozen food thawing, slow cookers, etc.

In the preceding detailed description, the disclosure is described with reference to specific exemplary embodiments thereof. Various modifications and changes may be made thereto without departing from the broader spirit and scope of the disclosure as set forth in the claims. The specification and drawings are, accordingly, to be regarded in an illustrative rather than a restrictive sense.

What is claimed is:

1. A refrigeration appliance having an automatic defrost cycle comprising:

a cabinet defining a freezer compartment;

a defrost cycle heater which provides a heat source during an automatic defrost cycle, wherein the defrost cycle heater includes one or more heated glass panels, the one or more heated glass panels having a conductive coating; a controller configured to control the defrost cycle heater during a defrost cycle;

wherein the cabinet further comprises:

an outer shell defining a cabinet exterior;

an inner liner defining a cabinet interior;

insulation disposed between the outer shell and the inner liner, wherein the insulation is a separate element from each of the inner liner and the outer shell, wherein the one or more heated glass panels are disposed between the inner liner and the insulation and spaced from the insulation thereby forming an air gap between the conductive coating of the one or more heated glass panels and the insulation and wherein the one or more heated glass panels directs heat back into the interior of the cabinet.

2. The refrigeration appliance of claim 1, further comprising: a door which provides access to the interior of the cabinet; an opening formed in the door; and an additional heated glass panel disposed in the opening formed in the door for providing a heat source and a viewing window.

3. The refrigeration appliance of claim 1, wherein at least one of the one or more heated glass panels includes a plurality of independently controllable heating elements, forming independently controllable areas on the respective heated glass panel.

4. The refrigeration appliance of claim 1, further comprising a fan for distributing heated air in the cabinet and wherein the one or more heated glass panels are further disposed adjacent to the inner liner.

5. The refrigeration appliance of claim 1, wherein the one or more heated glass panels are sheets of glass that include a transparent, electrically conductive coating applied to a surface of the glass.

6. The refrigeration appliance of claim 5, wherein the transparent, electrically conductive coating applied to the surface of the glass is tin(II) oxide.

7. The refrigeration appliance of claim 5, wherein the transparent, electrically conductive coating has a resistance and generates heat when current flows through the coating and wherein busbars that function as electrodes are formed at opposite edges of the glass so that a voltage differential can be applied to the busbars thereby causing current to flow through the coating.

8. The refrigeration appliance of claim 7, wherein the refrigeration appliance is free of a defrost air circulation fan.

9. The refrigeration appliance of claim 8, wherein one of the one or more heated glass panels is disposed in an opening formed in a door of the appliance and another of the one or more heated glass panels is disposed in a side wall of the appliance.

10. A refrigeration appliance comprising:

a refrigeration appliance cabinet having an outer shell defining a cabinet exterior and an inner liner defining a cabinet interior and a door providing access to the cabinet interior;

a defrost heater which provides heat during a defrost cycle, wherein the defrost heater includes a plurality of heated glass panels disposed between the inner liner and the outer shell;

wherein a first heated glass panel is disposed in an opening formed in the door that provides access to the interior of the cabinet and another heated glass panel is disposed between the cabinet exterior and the inner liner; and wherein:

the first heated glass panel comprises a sheet of glass that includes a transparent, electrically conductive coating applied to a surface of the first heated glass panel;

the another heated glass panel is disposed between the inner liner and insulation disposed between the outer shell and the inner liner and is spaced from the insulation thereby forming an air interface between the insulation and the another glass panel disposed between the cabinet exterior and the inner liner; and the transparent, electrically conductive coating directs heat back into the interior of the cabinet when an electric current is applied to the transparent, electrically conductive coating;

an insulation layer, wherein the insulation layer is a separate element from each of the inner liner and the outer shell;

wherein the transparent, electrically conductive coating directs heat back into the interior of the cabinet when an electric current is supplied to the transparent, electrically conductive coating.

11. The refrigeration appliance of claim 10, wherein the transparent, electrically conductive coating applied to the surface of the first heated glass panel is tin(II) oxide.

12. The refrigeration appliance of claim 11, wherein the transparent, electrically conductive coating has a resistance and generates heat when current flows through the coating and wherein busbars that function as electrodes are formed at opposite edges of a glass of the first heated glass panel so that a voltage differential can be applied to the busbars thereby causing current to flow through the coating.

13. The refrigeration appliance of claim 12, wherein the refrigeration appliance is free of a defrost air circulation fan.

14. A refrigeration appliance comprising:

a cabinet having an outer shell defining a cabinet exterior and an inner liner defining a cabinet interior with insulation spaced therebetween; wherein the insulation is a separate element from each of the inner liner and the outer shell;

and a door that provides access to the cabinet interior when open;

an automatic defrost cycle heater which provides a heat source during an automatic defrost cycle, wherein the defrost cycle heater includes one or more heated glass panels;

a controller configured to control the defrost heater during a defrost cycle;

one or more heated glass panels disposed between the inner liner and the insulation; and an additional heated glass panel disposed in an opening formed in the door wherein the additional heated glass panel includes a transparent, electrically conductive coating applied to a surface of the additional heated glass panel and the transparent, electrically conductive coating has a resistance and generates heat when current flows through the coating and wherein busbars that function as electrodes are formed at opposite edges of the additional heated glass panel so that a voltage differential can be applied to the busbars thereby causing current to flow through the coating;

wherein the additional heated glass panel is spaced from the insulation thereby forming an air interface between the insulation and the additional glass panel disposed between the cabinet exterior and the inner liner;

wherein the transparent, electrically conductive coating directs heat back into the interior of the cabinet when an electric current is supplied to the transparent, electrically conductive coating.

15. The refrigeration appliance of claim 14, wherein the transparent, electrically conductive coating is tin(II) oxide and wherein the refrigeration appliance is free of a defrost air circulation fan.

16. The refrigeration appliance of claim 14, further comprising a sensor, wherein the sensor provides feedback to the controller and the controller selectively energizes or regulates specific zones in the conductive coating.

17. The refrigeration appliance of claim 16, wherein the one or more heated glass panels are controlled using pulse width modulation.

18. The refrigeration appliance of claim 14, wherein the one or more heated glass panels remove frost buildup.

* * * * *